US005279753A

United States Patent [19]

Bloink et al.

[11] Patent Number: 5,279,753

[45] Date of Patent: Jan. 18, 1994

[54] WATER FREE ELECTRORHEOLOGICAL COMPOSITIONS INCLUDING $AM_{5-11}O_{8-17}$ WHERE M IS AL

[75] Inventors: Raymond L. Bloink, Swartz Creek; Bradley W. Kibbel, Ferndale; Bob R. Powell, Birmingham, all of Mich.

[73] Assignee: General Motors Corporation, Detroit, Mich.

[21] Appl. No.: 870,382

[22] Filed: Apr. 17, 1992

Related U.S. Application Data

[62] Division of Ser. No. 702,975.

[51] Int. Cl.[5] ..... C10M 171/00; C10M 169/04; C09K 3/00

[52] U.S. Cl. ..... 252/74; 252/71; 252/73; 252/572

[58] Field of Search ..... 252/71, 73, 74, 75, 252/572

[56] References Cited

U.S. PATENT DOCUMENTS

| | | | |
|---|---|---|---|
| 2,417,850 | 3/1947 | Winslow | 175/320 |
| 3,367,872 | 2/1968 | Martinek et al. | 252/75 |
| 3,367,872 | 2/1968 | Martinek et al. | 252/74 |
| 3,839,252 | 10/1974 | Bosso et al. | 260/29.2 EP |
| 4,645,614 | 2/1987 | Goossens et al. | 252/75 |
| 4,687,589 | 8/1987 | Block et al. | 252/73 |
| 4,744,914 | 5/1988 | Filisko et al. | 252/74 |
| 4,772,407 | 9/1988 | Carlson | 252/74 |
| 4,879,056 | 11/1989 | Filisko et al. | 252/74 |

FOREIGN PATENT DOCUMENTS

| | | |
|---|---|---|
| 0311984 | 4/1989 | European Pat. Off. . |
| 0361931 | 4/1990 | European Pat. Off. . |
| 0387857 | 9/1990 | European Pat. Off. . |
| WO82/04442 | 12/1982 | PCT Int'l Appl. . |
| 1570234 | 6/1980 | United Kingdom . |

OTHER PUBLICATIONS

"Introduction to Ceramics", see Fast Ion Transport, pp. 859–863, 1976.

Hong et al, "High Na+-Ion Conductivity in $Na_5YSi_4O_{12}$", Mat. Res. Bull. vol. 13, pp. 757–761, 1978. Pergamon Press, Inc. Printed in the U.S.

Clearfield et al, "New Crystalline Phases of Zirconium Phosphate Processing Ion-Exchange Properties", J. inorg. nucl. Chem. 1968, vol. 30, pp. 2249–2258. Pergamon Press. Printed in Great Britain.

Hong, "Crystal Structures and Crystal Chemistry in System $Na_{1+x}Zr_2Si_xP_{3-x}O_{12}$", Mat. Res. Bull. vol. 11, pp. 173–182, 1976. Pergamon Press, Inc. Printed in the U.S.

Maazaz et al, "Sur Une Nouvelle Famille De Conducteurs Cationiques A Structure Feuilletee De Formule $K_x(L_{x/2}Sn_{1-x/2})O_2$(L=Mg, Ca, Zn, $x \leqq 1$)", Mat. Res. Bull. vol. 14, pp. 193–199, 1979. Printed in the USA. 0025-5408/79/020193-782.00/0 Copyright ©Pergamon Press Ltd.

Goodenough et al, "Fast Na+-Ion Transport in Skeleton Structures", Mat. Res. Bull. vol. 11, pp. 203–220, 1976. Pergamon Press, Inc. Printed in the U.S.

Alberti et al, "All Solid State Hydrogen Sensors Based on Pellicular ∝-Zirconium Phosphate as a Protonic Conductor", Solid State Ionics, vol.35, No. 1, 2 Jul.-/Aug. 1989, pp. 153–156.

(List continued on next page.)

*Primary Examiner*—Christine Skane
*Attorney, Agent, or Firm*—Cary W. Brooks

[57] ABSTRACT

Disclosed are electrorheological fluids having ceramic particles of high ion conductivity and a nonconducting or dielectric fluid. The high ion conductive particle may be a beta-alumina material, such as a material having the formula $AM_{5-11}O_{8-17}$, where A is a monovalent ion, such as a material comprising at least one selected from the group consisting of Li, Na, K, Rb, Ag and Te; and M is a trivalent ion, such as a material comprising at least one selected from the group consisting of Al, Fe and Ga. The liquid phase may include a silicone fluid or mineral oil. In the case of a mineral oil, the oil may also include an amine-terminated polyester to improve stability of the fluid.

13 Claims, 1 Drawing Sheet

OTHER PUBLICATIONS

Shannon et al, "Ionic Conductivity in $Na_5YSiO_{12}$-Type Silicates", Inorganic Chemistry, vol. 17, No. 4, 1978, pp. 958-964.

Miller et al, "A Prepilot Process for the Fabrication of Polycrystalline $\beta''$-Alumina Electrolyte Tubing", Ceramic Bulletin, vol. 58, No. 5 (1979), pp. 522-526.

Hooper et al, "Ionic Conductivity of Pure and Doped $Na_3PO_4$", Journal of Solid State Chemistry 24, 265-275 (1978).

West, "Ionic Conductivity of Oxides Based on $Li_4SiO_4$", Journal of Applied Electrochemistry 3 (1973), pp. 327-335.

Hu et al, "Ionic Conductivity of Lithium Phosphate-Doped Lithium Orthosilicate", Mat. Res. Bull. vol. 11, pp. 1227-1230, 1976. Pergamon Press, Inc. Printed in the U.S.

Hu et al, "Ionic Conductivity of Lithium Orthosilicate-Lithium Phosphate Solid Solutions", J. Electrochem. Soc.:Solid-State Science and Technology, vol. 124, No. 8, Aug. 1977, pp. 1240-1242.

Delmas et al, "Ionic Conductivity in Sheet Oxides", Copyright 1979 by Elsevier North Holland, Inc. Vashishta, Mundy, Shenoy, eds. Fast Ion Transport in Solids, pp. 451-454.

Delmas, "Sur De Nouveaux Conducteurs Ioniques A Structure Lamellaire", Mat. Res. Bull. vol. 11, pp. 1081-1086, 1976. Pergamon Press, Inc. Printed in the U.S.

Hawley's Condensed Chemical Dictionary, Eleventh Edition, Copyright 1987, pp. 38, 42, 142, and 551-552, defining "beta, alpha, gamma, allotropy".

Sidney H. Avner, "Introduction to Physical Metallurgy", Second Edition, Copyright 1974, selected page defining alpha-iron.

Kirk-Othmer, "Encyclopedia of Chemical Technology", Third Edition, vol. 5, Copyright 1979, pp. 299-301, which describes Oxides with the $\beta$-Alumina Structure.

Block et al, "Electro-rheology",J. Phys. D: Appl. Phys., 21(12), 1661-1677, 1988.

Hawley's Condensed Chemical Dictionary, Eleventh Edition (1987) by Van Nostrand Reinhold Co., Inc. pp. 42 & 48-definition of "Alumina".

Technical Bulletin 1, Kaiser Chemical Division, Kaiser Aluminum and Chemicals Corp., Baton Rouge, La., 1967-Figure 1., Thermal Degradation of Aluminas.

WATER FREE ELECTRORHEOLOGICAL COMPOSITIONS INCLUDING $AM_{5-11}O_{8-17}$ WHERE M IS AL

This is a division of application Ser. No. 07/702975 filed on May 20, 1991 now U.S. Pat. No. 5,149,454.

FIELD OF THE INVENTION

The present invention relates to fluid compositions which demonstrate significant changes in their flow properties in the presence of an electric field.

BACKGROUND OF THE INVENTION

Electrorheology is a phenomenon in which the rheology of a fluid is modified by the imposition of an electric field. Fluids which exhibit significant changes in their properties of flow in the presence of an electric field have been known for several decades. The phenomenon of electrorheology was reported by W. M. Winslow, U.S. Pat. No. 2,417,850, in 1947. Winslow demonstrated that certain suspensions of solids in liquids show large, reversible electrorheological effects. In the absence of an electric field, electrorheological fluids generally exhibit Newtonian behavior. That is, the applied force per unit area, known as shear stress, is directly proportional to the shear rate, i.e., change in velocity per unit thickness. When an electric field is applied, a yield stress appears and no shearing takes place until the shear stress exceeds a yield value which generally rises with increasing electric field strength. This phenomenon can appear as an increase in viscosity of up to several orders of magnitude. The response time to electric fields is on the order of milliseconds. This rapid response, characteristic of electrorheological fluids, makes them attractive to use as elements in mechanical devices.

A complete understanding of the mechanisms through which electrorheological fluids exhibit their particular behavior has eluded workers in the art. Many have speculated on the mechanisms giving rise to the behavior characteristics of electrorheological fluids.

A first theory is that the applied electric field restricts the freedom of particles to rotate, thus changing their bulk behavior.

A second theory ascribes the change in properties to the filament-like aggregates which form along the lines of the applied electric field. The theory proposes that this "induced fibrillation" results from small, lateral migrations of particles to regions of high field intensity between gaps of incomplete chains of particles, followed by mutual attraction of these particles. Criticism of a simple fibrillation theory has been made on the grounds that the electrorheological effect is much too rapid for such extensive structure formation to occur; workers in the art have observed a time scale for fibrillation of approximately 20 seconds, which is vastly in excess of the time scale for rheological response of electrorheological fluids. On the other hand, response times for fibrillation on the order of milliseconds have been observed.

A third theory refers to an "electric double layer" in which the effect is explained by hypothesizing that the application of an electric field causes ionic species adsorbed upon the discrete phase particles to move, relative to the particles, in the direction along the field toward the electrode having a charge opposite that of the mobile ions in the adsorbed layer. The resulting charge separation and polarization could lead to "dipole" interactions and fibrillation.

Yet another theory proposes that the electric field drives water to the surface of discrete phase particles through a process of electro-osmosis. The resulting water film on the particles then acts as a glue which holds particles together. If correct, then a possible sequence of events in fibrillation would be: ionic migration, subsequent electro-osmosis of moisture to one pole of the particle (presumably the cationic region) and bridging via this surface supply of water. However, the advent of anhydrous electrorheological fluids means that water-bridging is not an essential mechanism and may indeed not be operative at all.

Despite the numerous theories and speculations, it is generally agreed that the initial step in development of electrorheological behavior involves polarization under the influence of an electric field. This then induces some form of interaction between particles or between particles and the impressed electric or shear fields which results in the rheological manifestations of the effect. See Carlson, U.S. Pat. No 4,772,407; and Block et al "Electro-Rheology", IEEE Symposium, London, 1985. Despite this one generally accepted mechanism, the development of suitable electrorheological fluids and methods of improving the same remains largely unpredictable.

The potential usefulness of electrorheological fluids in automotive applications, such as vibration damping, shock adsorbers, or torque transfer, stems from their ability to increase, by orders of magnitude, their viscosity upon application of an electric field. This increase can be achieved with very fast (on the order of milliseconds) response times and with minimal power requirements.

Although ER-fluids have been formulated and investigated since the early 1940's, basic limitations have prevented their utilization in practical devices. The most restrictive requirements are that (1) the suspensions be stable overtime; i.e., that the solid particles either remain suspended in the liquid or be readily redispersed if sedimentation occurs and (2) service and durability of the suspensions can be achieved outside the temperature range of 0°-100° C. This latter requirement is particularly restrictive in that most fluid compositions require water as an ER "activator" so that in completely nonaqueous systems the ER-effect is entirely absent or so small that it is not effectively useful.

An object of this invention is to formulate a stable, substantially water-free, or nonaqueous ER-fluid with improved properties.

SUMMARY OF THE INVENTION

This invention generally includes electrorheological fluids having ceramic particles of high ion conductivity and a nonconducting or dielectric fluid. The high ion conductive particle may be a beta-alumina material, such as a material having the formula $AM_{5-11}O_{8-17}$, where A is a monovalent ion, such as a material comprising at least one selected from the group consisting of Li, Na, K, Rb, Ag and Te; and M is a trivalent ion such, as a material comprising at least one selected from the group consisting of Al, Fe and Ga. These ceramic particles of high ion conductivity eliminate the need for water in the electrorheological fluids. It is believed that the structure of the material is such that ions are mobile within and/or on the surface of the particle. These mobile ions produce a charge separation (dipoles) on the surface of the particle in the presence of an electric field. Under the influence of an electric field, the dipoles of the particles could interact resulting in chains of particles extending between electrodes and which require additional energy to shear. Such chains produce a higher viscosity in the electrorheological fluid. Where the invention comprises anhydrous fluids, the elimination of the requirement for water in the electrorheological fluid increases the temperature range in which the electrorheological fluid may operate.

These and other objects, features and advantages of this invention will be apparent from the following detailed description, appended drawings and claims.

BRIEF DESCRIPTION OF THE DRAWINGS

In FIG. 1 the liquid phase was a silicone fluid and in FIG. 2 the liquid phase was mineral oil.

DETAILED DESCRIPTION OF THE INVENTION

The solid phase of an electrorheological fluid according to the present invention comprises a high ion conductive material including a material such as beta alumina and preferably having the formula $AM_{5-11}O_{8-17}$, where A is a monovalent ion, such as at least one selected from the group consisting of Li, Na, K, Rb, Ag, and Te; and where M is a trivalent ion, such as at least one selected from the group consisting of Al, Fe and Ga. Solid phase materials may be prepared by conventional ceramic techniques known to those skilled in the art. A suitable method of preparing solid phase materials is disclosed in Miller et al, "A Prepilot Process for the Fabrication of Polycrystalline B-Alumina Electrolyte Tubing", Ceramic Bulletin, Vol. 58, No. 5 (1979), pages 522–526, which is hereby incorporated by reference.

Preferably, the materials of the solid phase are in the form of particles such as spheres, cubes, whiskers or platelets. Preferably, the particles are equiaxed. The particles have an effective length or diameter ranging from about 0.1 to about 75 micrometers. The particles may be present in the fluid in an amount ranging from about 5 to about 50, and preferably about 15 to about 30 percent by volume of the composition.

Preferably, the material of the solid phase is dried at a temperature ranging from about 200° C. to about 600° C., preferably 400° C. to about 600° C. and most preferably 600° C., which is sufficient to remove any residual water on the solid phase but not alter the structure of the solid. The particles are referred to as being substantially free of water. The term "substantially free of water" means less than 0.5 percent by weight water adhering (i.e., absorbed or adsorbed) to the particles. Preferably, the amount of water adhering to the particles is less than that required for the water to be an "activator" of electrorheological response. That is, the amount of water adhering to the particles of the solid phase is not sufficient to create water bridges between particles under the influence of an electric field. The drying of the particles is carried out under low vacuum at a constant pressure. Preferably the drying is at a pressure ranging from about 300 to about 50 mTorr, preferably 200 to about 50 mTorr and most preferably at 50 mTorr. The resultant, dry particles are then dispersed in a liquid phase.

Suitable liquid phase materials include any nonconductive substance that exists in a liquid state under the conditions which a fluid made using it would be employed. Any nonconducting fluid in which particles could be dispersed would be suitable. A preferred fluid is silicone fluid. Other suitable liquid phase materials are disclosed in Block et al, "Electro-Rheology", IEEE Symposium, London, 1985, which is hereby incorporated by reference. A suitable silicone fluid is commercially available from Union Carbide under the trade name SILICONE FLUID L45/10 TM.

Figure 1:
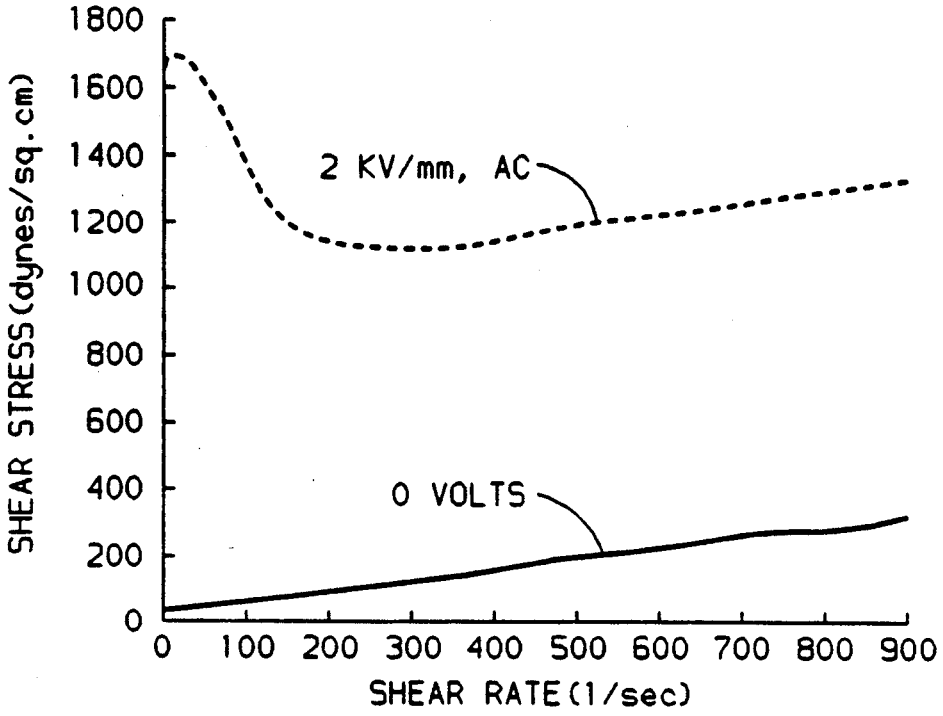
FIG. 1 and FIG. 2 are graphic illustrations of the viscosity of an electrorheological fluid according to the present invention both in the presence and absence of an electric field.
Figure 2:
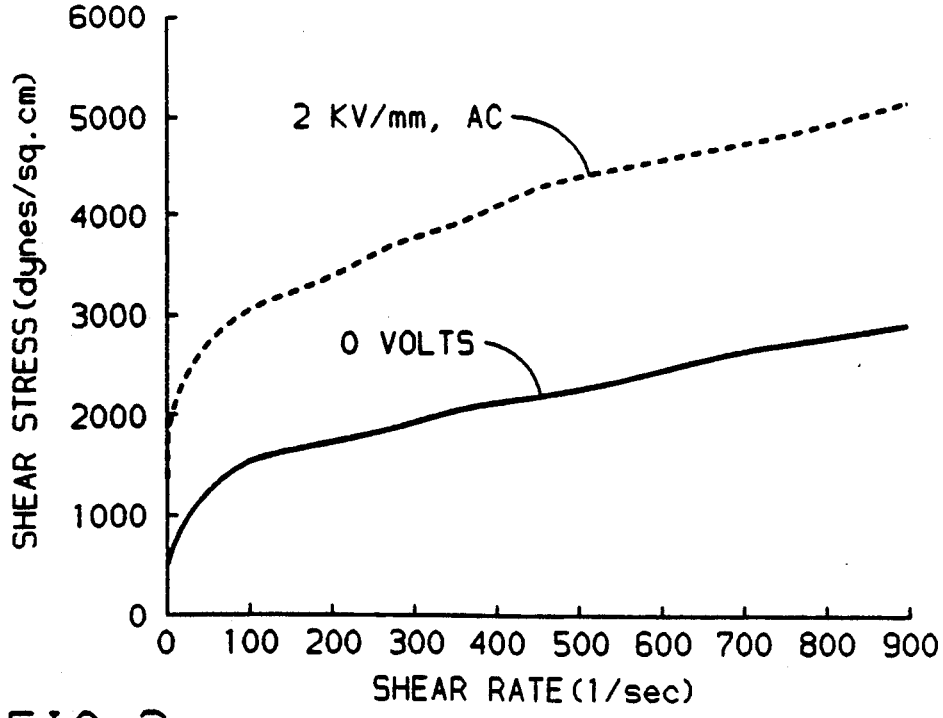

The stability of the electrorheological fluid may be improved by adding a dispersant or stabilizer to the liquid phase. When the liquid phase is a mineral oil, a preferred stabilizer is an amine-terminated polyester, such as SOLSPERSE 17000 TM available from ICI Americas. Electrorheological fluids were prepared as described above wherein the solid phase consisted of a material having the composition $NaAl_5O_8$ and the liquid phase consisted of silicone fluid (FIG. 1) and mineral oil (FIG. 2). As can be seen, in the presence of an electric field the fluids exhibited a dramatic increase in viscosity compared to the fluids in the absence of electric field.

The various embodiments may be combined and varied in a manner within the ordinary skill of persons in the art to practice the invention and to achieve various results as desired.

Where particular aspects of the present invention are defined herein in terms of ranges, it is intended that the invention includes the entire range so defined, and any sub-range or multiple sub-ranges within the broad range. By way of example, where the invention is described as comprising one to about 100 percent by weight component A, it is intended to convey the invention as including about five to about 25 percent by weight component A, and about 50 to about 75 percent by weight component A. Likewise, where the present invention has been described herein as including $A_{1-100}B_{1-50}$, it is intended to convey the invention as $A_{1-60}B_{1-20}$, $A_{60-100}B_{25-50}$ and $A_{43}B_{37}$.

The embodiments of the invention in which an exclusive property or privilege is claimed are defined as follows:

1. An electrorheological composition comprising
   - a solid phase present in an amount ranging from about 5 to about 50 percent by volume of said composition comprising
   - a material having the formula $AM_{5-11}O_{8-17}$, where A is a monovalent ion and M is a Al; and
   - a liquid phase comprising a dielectric fluid, said solid phase having less than 0.5 percent by weight water adhering thereto and effective to produce an electrorheological response in the presence of an electric field.

2. An electrorheological composition as set forth in claim 1 wherein A is at least one selected from the group consisting of Li, Na, K, Rb, Ag, and Te.

3. An electrorheological composition as set forth in claim 1 wherein said solid phase composition comprises $NaAl_5O_8$.

4. An electrorheological composition as set forth in claim 1 wherein said solid phase composition comprises particles having a size ranging from about 1 to about 5 micrometers in length.

5. An electrorheological composition as set forth in claim 1 wherein said solid phase is about 15 to about 30 volume percent of said electrorheological composition.

6. An electrorheological composition as set forth in claim 1 wherein said liquid phase comprises silicone fluid.

7. An electrorheological composition as set forth in claim 1 wherein said liquid phase comprises mineral oil.

8. A method of producing an electrorheological response in a composition comprising:

adding a material having the formula $AM_{5-11}O_{8-17}$, where A is at least one selected from the group consisting of Li, Na, K, Rb, Ag and Te, and M is Al, to a liquid comprising a dielectric fluid to form an electrorheological composition and so that the material is present in an amount ranging from about 5 to about 50 percent volume of said composition, said composition having less than 0.5 percent by weight water adhering to said material; and applying an electric potential to said composition so that said composition increases in viscosity.

9. A method as set forth in claim 8 wherein said material comprises $NaAl_5O_8$.

10. An electrorheological composition as set forth in claim 1 wherein said material comprises $AM_7O_{11}$ and M is Al.

11. A method as set forth in claim 8 wherein said material comprises $AM_7O_{11}$ and M is Al.

12. An electrorheological composition as set forth in claim 1 wherein said solid phase consists essentially of $AM_{11}O_{17}$, where M is Al.

13. A method as set forth in claim 8 wherein said material consists essentially of $AM_{11}O_{17}$, where M is Al.

* * * * *